US011466232B2

(12) United States Patent
Narayan et al.

(10) Patent No.: US 11,466,232 B2
(45) Date of Patent: Oct. 11, 2022

(54) FORMULA FOR SUPERIOR DETERGENCY AND ANTI RE-DEPOSITION BENEFIT

(71) Applicant: SABIC GLOBAL TECHNOLOGIES B.V., Bergen op Zoom (NL)

(72) Inventors: Karumanassery Chidambara Iyer Narayan, Riyadh (SA); Flaiyh Farhan N. Al-Anazi, Riyadh (SA); Mohammed S. Bakalla, Riyadh (SA); Qasem Ahmed A. Ghazwani, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 129 days.

(21) Appl. No.: 16/345,867

(22) PCT Filed: Oct. 30, 2017

(86) PCT No.: PCT/IB2017/056742
§ 371 (c)(1),
(2) Date: Apr. 29, 2019

(87) PCT Pub. No.: WO2018/078603
PCT Pub. Date: May 3, 2018

(65) Prior Publication Data
US 2019/0249114 A1 Aug. 15, 2019

Related U.S. Application Data

(60) Provisional application No. 62/415,131, filed on Oct. 31, 2016.

(51) Int. Cl.
*C11D 1/72* (2006.01)
*C11D 1/825* (2006.01)
*C11D 3/36* (2006.01)

(52) U.S. Cl.
CPC ..... *C11D 1/8255* (2013.01)

(58) Field of Classification Search
CPC ..... C11D 1/72; C11D 1/825; C11D 1/8255; C11D 3/1226; C11D 3/36
See application file for complete search history.

(56) References Cited

U.S. PATENT DOCUMENTS

| | | | | |
|---|---|---|---|---|
| 2,886,533 | A | 5/1959 | Bacon et al. | |
| 3,948,819 | A | 4/1976 | Wilde | |
| 4,235,735 | A | 11/1980 | Marco et al. | |
| RE30,472 | E | 1/1981 | Teot et al. | |
| 4,597,898 | A | 7/1986 | Vander Meer | |
| 4,622,378 | A | 11/1986 | Gosselink | |
| 4,664,848 | A | 5/1987 | Oh et al. | |
| 5,972,861 | A | 10/1999 | Rolfes | |
| 7,417,017 | B2 | 8/2008 | Bastigkeit et al. | |
| 2007/0225189 | A1* | 9/2007 | Dailey | C11D 1/8305 510/292 |
| 2008/0188396 | A1* | 8/2008 | Holland | C11D 1/8305 510/421 |
| 2014/0155312 | A1 | 6/2014 | Soontravanich et al. | |

FOREIGN PATENT DOCUMENTS

| | | | |
|---|---|---|---|
| CA | 1140832 | | 2/1983 |
| CA | 2679110 | A1 | 9/2008 |
| CN | 101389398 | | 3/2009 |
| EP | 000225 | A1 | 1/1979 |
| EP | 0916717 | A1 | 5/1999 |
| EP | 2771444 | | 9/2014 |
| GB | 1442855 | | 7/1976 |
| WO | 9411488 | A1 | 5/1994 |
| WO | 9612782 | A1 | 5/1996 |
| WO | 2005080538 | A1 | 9/2005 |
| WO | 2007064525 | A1 | 6/2007 |
| WO | WO 2007/096292 | | 8/2007 |
| WO | 2011109316 | A1 | 9/2011 |
| WO | 2013081881 | A1 | 6/2013 |

OTHER PUBLICATIONS

Jadidi, et al. "Synergism and Performance Optimization in Liquid Detergents Containing Binary Mixtures of Anionic-Nonionic, and Anionic-Cationic Surfactants," *Journal of Surfactants and Detergents*, 2013, 16(1):115-121.
Jurado, et al. "Wetting Power in Aqueous Mixtures of Alkylpolyglucosides and Ethoxylated Fatty Alcohols," *Journal of Surfactants and Detergents*, 2010, 13:497-501.
Office Action issued in counterpart Chinese Patent Application No. 201780067520.6, dated Jun. 19, 2020. (English Translation Provided).
International Search Report for PCT/IB2017/056742; Date of Filing Oct. 30, 2017; dated Feb. 16, 2018; 6 pages.
Martin et al. "Synergistic Effect on Wettability of Mixtures of Amine Oxides, Alkylpolyglucosides, and Ethoxylated Fatty Alcohol"; J Surfact Deterg, vol. 17, 2014, pp. 1035-1042.
Rittig F et al: "Surfactant Blends for Emulsifying and Cleaning", SOFW Journal, vol. 135, No. 10, Oct. 1, 2009, pp. 16-18, 20, XP001548794, ISSN: 0942-7694.
Szymczyk, "The Properties of Binary Mixtures of Ethoxylated Octyl Phenols with Ethoxylated Fluorinated Alkanols at the Water/Air Interface"; J Surfact Deterg, vol. 14, 2011, pp. 415-423.
Written Opinion for PCT/IB2017/056742; Date of Filing Oct. 30, 2017; dated Feb. 16, 2018; 7 pages.

* cited by examiner

*Primary Examiner* — Brian P Mruk
(74) *Attorney, Agent, or Firm* — Norton Rose Fulbright US LLP

(57) ABSTRACT

A composition includes a C10 aliphatic branched chain alcohol ethoxylate; a C12 aliphatic straight chain alcohol ethoxylate, and a reactive builder. The composition effects an increase of at least about 30% in detergency measured as reflectance at 460 nanometers (nm) of a stained fabric at which the composition has been applied when compared to reflectance observed at 460 nm at the stained fabric prior to application of the composition. The stained fabric treated at which the composition has been applied exhibits a reflectance at 460 nm that is greater than the reflectance of the stained fabric at which a substantially similar composition has been applied. The substantially similar composition includes nonyl phenol ethoxylate.

4 Claims, No Drawings

FORMULA FOR SUPERIOR DETERGENCY AND ANTI RE-DEPOSITION BENEFIT

CROSS REFERENCE TO RELATED APPLICATIONS

This application is a 371 of International Application No. PCT/IB2017/056742, filed Oct. 30, 2017, which is incorporated by reference in its entirety, and which claims priority to U.S. Ser. No. 62/415,131, filed Oct. 31, 2016.

TECHNICAL FIELD

The disclosure concerns compositions including a combination of certain alkoxylated ethoxylates and detergent builders to provide improved effectiveness as a detergent.

BACKGROUND

For efficient laundering of fabrics, laundry detergent compositions generally include a variety of active ingredients, such as one or more anionic surfactants, combined with a nonionic surfactant, detergent builder materials such as alkali metal carbonates and zeolites. Accordingly, the use of synthetic laundry detergents including mixtures of anionic and nonionic surfactants has been well documented in the patent literature. Cationic surfactants are known in the art as useful components of heavy duty liquid detergent compositions. Still, there exists a general notion that anionic and cationic surfactants are not suitable in the same composition without decreased efficacy due to the interaction of the positively charged cationic with the negatively charged anionic in the wash bath. Thus, detergents predominantly contain a conventional sulfonated anionic surfactant and/or a conventional ethoxylated nonionic surfactant among a number of other enhancing components which may include detergent builders, polycarboxylates, optical brighteners, alkaline sources, anti-redeposition agents, pH modifiers, emulsifiers, and viscosity modifiers. However, there remains a need in the art for detergent compositions that exploit the detergency and anti-redeposition properties of nonionic surfactants as the primary detergent component.

SUMMARY

The present disclosure relates to compositions including: a C10 aliphatic branched chain alcohol ethoxylate; and a C12 aliphatic straight chain alcohol ethoxylate; a reactive builder. The composition effects an increase of at least about 30% detergency measured as in reflectance observed at 460 nanometers (nm) of a stained fabric at which the composition has been applied when compared to reflectance observed at 460 nm at the stained fabric prior to application of the composition. The stained fabric treated at which the composition has been applied exhibits a reflectance at 460 nm that is greater than the reflectance of the stained fabric at which a substantially similar composition has been applied. The substantially similar composition includes nonyl phenol ethoxylate.

While aspects of the present disclosure may be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Conventional laundry detergent compositions often include an anionic sulfonate or sulfate surfactant, such as linear alkyl benzene sulfonate (LABS) or primary alcohol sulfate (PAS), as the principal detergent-active ingredient. The anionic surfactants are typically used with ethoxylated alcohols as nonionic surfactants to provide improved detergency on soils and stains. The anionic and anionic/nonionic surfactant systems are considered robust and highly efficient for a range of stains and a number of laundering conditions. The compositions of the present disclosure provide efficient detergent compositions including mixtures of nonionic ethoxylated alcohols as the principal detergent. A mixture of aliphatic straight chain alcohol ethoxylate and aliphatic branched chain alcohol ethoxylate may exhibit improved detergency and anti-redeposition properties when compared to the properties of the individual ethoxylates or a conventional surfactant nonyl phenol ethoxylate. More specifically, a mixture of C10 branched chain alcohol with 5 moles of ethylene oxide (DA5) and a C12 straight chain alcohol with 7 moles of ethylene oxide (L7) in the presence of a builder afforded improved detergency and anti-redeposition.

Surfactants are surface active agents and are the primary components of detergents and other cleansing compositions. Surfactants are amphiphilic molecules as they include both hydrophilic and hydrophobic portions which aid in cleansing. When in contact with stains or soils in solution, the hydrophilic, nonpolar region of the surfactant is attracted to water, and the lipophilic (or hydrophobic) region to the oil of the stain or soil. With agitation, the surfactant molecules surround the oil globules, forming micelles, which can then be dislodged from the substrate. Non-ionic surfactants are surfactants without an overall electric charge. Unlike surfactants with surface properties due to a positive charge (such as cationic surfactants) or a negative charge (such as anionic reactants), non-ionic surfactants do not react with other ions and do not ionize in solution. Alkoxylated alcohols represent an industrially important class of nonionic surfactants. These alcohols, such as ethoxylated alcohols, are often good wetting agents, a desirable attribute for cleansing surfaces and materials. The detergent compositions described herein include a combination of certain ethoxylated alcohols in the presence of a builder to achieve particular detergency and anti-redeposition properties.

In one aspect, the compositions may include a branched chain ethoxylated alcohol and a linear ethoxylated alcohol in the presence of a detergent builder. The ethoxylated alcohols as described herein may have the structure as in formula 1.

$$R\text{-}(OCH_2CH_2)_n OH \quad (1)$$

wherein R includes a hydrocarbyl or alkyl moiety as the hydrophobic/lipophilic portion of the surfactant and wherein n corresponds to the number of moles of ethylene oxide (or ethyleneoxy, EO) present per mole of alcohol. The EO units correspond to the hydrophilic or water soluble portions of the surfactant molecule. Generally the larger the value of n, the more water soluble the surfactant. A surfactant may have value of n up to about 100. In some aspects, n is at least about 2. In further aspects, n is about 14 or less, alternatively about 12 or less. Wherever a degree of alkoxylation (or ethoxylation) is discussed the numbers referred to are molar average numbers, essentially corresponding to the reaction of the indicated number of moles of alkylene (or ethylene) oxide with one more of alcohol.

The compositions described herein may include a branched chain ethoxylated alcohol. A branched ethoxylated alcohol may be represented as in formula 1 where R includes a branched hydrocarbyl moiety. For the branched ethoxylated alcohol, the branched hydrocarbyl moiety (R) may contain between 5 and 16 carbon atoms. In some aspects, the group contains between 7 and 12 carbon atoms. In one aspect, the R group may include 10 carbon atoms. In a specific example, the composition includes a C10 branched ethoxylated alcohol. The branched ethoxylated alcohol may include from about from about 2 to about 10 EO units. For example, the branched ethoxylate may include 5 moles EO. Thus, in one aspect, the composition described herein may include a C10 branched ethoxylated alcohol including 5 moles EO (5EO). The branched ethoxylated alcohol ethoxylate may include an isodecyl alcohol ethoxylate. As an example, the branched ethoxylated alcohol may be characterized by formula 2:

(2)

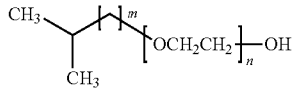

wherein m is an integer, between, for example, 3 and 14 and n corresponds to EO units.

In a specific example, the branched ethoxylated alcohol may include a compound having the structure according to formula (3)

(3)

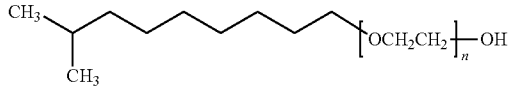

wherein n is 5.

As provided herein the composition may include a straight chain, or linear, ethoxylated alcohol. The linear ethoxylated alcohol may correspond to formula 1 where R is a linear hydrocarbyl or alkyl group wherein each carbon atom is bound to its two neighbors and to two hydrogen atoms and wherein the terminal carbon atom is bound to only one carbon atom and three hydrogen atoms. The linear hydrocarbyl group may contain between 7 and 16 carbon atoms. In some aspects, the group contains between 9 and 15 carbon atoms. In one aspect, the straight chain hydrocarbyl group may include 12 carbon atoms. In a specific example, the composition includes a C12 linear ethoxylated alcohol. The C12 linear ethoxylated alcohol may include lauryl alcohol ethoxylate.

As an example, the linear ethoxylated alcohol may include a compound having the structure according to formula 4.

(4)

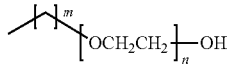

wherein m is an integer, between, for example, 8 and 14 and n, corresponds to EO units.

The straight chain ethoxylated alcohol may include from about 2 to about 10 EO units. For example, the branched ethoxylate may include 7 moles EO. Thus, in one aspect, the composition described herein may include a C12 straight-chain ethoxylated alcohol including 7 moles EO (7EO). More specifically, the composition may include a lauryl alcohol ethoxylate 7EO according to formula (5).

(5)

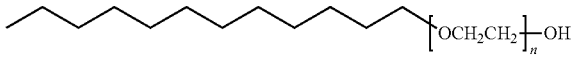

wherein n is 7.

The branched C10 alcohol ethoxylate and the linear C12 ethoxylated alcohol may be present in the composition in a particular ratio. In one aspect, the branched C10 alcohol ethoxylate and the linear C12 ethoxylated alcohol may be present in a 1:1 weight ratio.

In certain aspects of the present disclosure, the ethoxylated alcohols described herein may be substituted with a propoxylated alcohol. That is, the alcohol may include one or more units of propylene oxide (PO) ($—OCH_2CH_2CH_2—$) in lieu of ethylene oxide. Thus, for the foregoing structures, n may correspond to PO units rather than EO units. A propoxylated alcohol may thus also be used as the hydrotrope disclosed herein and combined with the alkaline solution. Thus a C10 branched propoxylated alcohol or a C12 straight chain propoxylated alcohol may be useful in the compositions described herein.

The composition of the present disclosure may include a C10 branched ethoxylated alcohol including 5 moles EO and a C12 straight-chain ethoxylated alcohol including 7 moles EO in the presence of a detergent builder. A detergent builder, or as used herein, a builder or reactive builder, is a compound that may be added to a detergent product to enhance cleansing action. Builders have a number of functions including softening, buffering, emulsifying, and removal of multivalent cations from water. Builders may accomplish these functions by, for example, sequestration, holding metal ions in solution; or by precipitation, removing ions from solution as insoluble material (precipitate). Builders may also provide a desirable level of alkalinity which aids in cleaning. They help emulsify oily or greasy soil by breaking them up to tiny globules and keep it from settling back on the cleaned surface.

The builder may be an organic compound or an inorganic compound. Generally, inorganic builders may include water-soluble inorganic alkali metal salts, such as alkali metal carbonates, borates, phosphates, polyphosphates, and silicates. These inorganic builders may be include layered silicate, and amorphous aluminosilicates. Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxy-methyloxymalonates, dipicolinates, hydroxyethyliminodiacetates, alkyl- and alkenylmalonates and succinates; and sulfonated fatty acid salts. Other organic builders include N-diethyleneglycol-N, N-diacetic (DID A) acid polyphosphates (e.g., potassium pyrophosphate), nitrilotriacetates (e.g., $Na_3NTA$), sodium ethylenediaminetetraacetate (EDTA), sodium ethylenetriaminepentaacetate, sodium citrate, sodium carbonate (such as soda ash), sodium metasilicate and zeolites. Enzymes such as proteases and amylases are also frequently present in cleaner compositions, especially laundry detergent products and prewash products.

Organic builders may be used in minor amounts as supplements to inorganic builders such as phosphates and zeolites. Builders whether inorganic and organic, may be present in alkali metal salt, especially sodium salt, form. Suitable builders may be used in amounts of from 0.01 wt. % to 30 wt. %, more specifically from 10 wt. % to 25 wt. %. In some examples, a builder may be present in the disclosed composition in an amount of from 0.01 wt. % to 5 wt. % or from about 0.01 wt. % to about 5 wt. %, or from 0.01 wt. % to 1 wt. % or from about 0.01 wt. % to about 1 wt. %, or 0.05 wt. % or at about 0.05 wt. %. However, unbuilt compositions are also within the scope of the disclosure.

The pH of the compositions provided herein, as measured by a conventional pH meter at room temperature (RT) is from 6 to 12 or about 6 to about 12, more specifically from 9 to 11, or from about 9 to 11.

An exemplary builder class according to the present disclosure includes phosphate builders, especially sodium tripolyphosphate. Sodium tripolyphosphate may be used in combination with sodium orthophosphate, and/or sodium pyrophosphate.

Often detergents include mixed ethoxylates as non-ionic surfactants in addition to other common detergent components such as, for example, anionic surfactants, cationic surfactants, enzymes, polycarbonates, optical brighteners, etc. In some aspects, the compositions of the present disclosure provide the detergency and anti-re-deposition properties of certain ethoxylated alcohols with only a builder. The detergent composition may thus be simplified, but maintain efficiency as a detergent formulation.

In a specific example, the compositions described herein also exhibited improved detergency compared to common nonionic surfactant nonyl phenol ethoxylate. As such, compositions of the present disclosure may be free of, or substantially free of nonyl phenol ethoxylate. As used herein, "substantially free of" may be interpreted that a given substance or component, i.e., nonyl phenol ethoxylate, has not been added purposively to the composition.

The compositions disclosed herein may be provided in liquid form or can be provided in solid or powdered form. In some examples, the provided cleansing compositions are formulated as a heavy-duty detergent powder, heavy-duty detergent liquid, dishwashing liquid, machine dishwashing detergents, institutional detergents, detergent liquids, laundry aid, pretreatment aid, after-treatment aids, presoaking product, hard surface cleaner, or carpet cleaner.

The disclosed compositions include a C10 branched chain ethoxylated alcohol having 5 moles ethylene oxide units combined with C12 straight chain ethoxylated alcohol having 7 moles ethylene oxide in the presence of a builder. Improved properties after laundry wash trial when compared to other individual ethoxylates as well as other mixed ethoxylated alcohol blends.

Detergency and re-deposition may be assessed based upon the reflectance observed at a stained fabric and the detergency observed at the stained fabric after an application of a given detergent composition. Performance as a detergent may be evaluated according to the principle that a deposit of material (or a stain) on a fabric would result in a lower reflectance of light observed at the fabric. In turn, the removal of such a deposit would increase the reflectance of light observed at the fabric. Thus, the higher the reflection of light, the greater the greater the extent to which the stain has been removed and the better detergent performance of the composition. Detergency of the compositions may be determined using aqueous solutions including the compositions described herein. A stained fabric treated with an application of the disclosed composition may exhibit higher reflectance values than a fabric treated with an individual alcohol ethoxylate or other combinations of alcohol ethoxylates. With respect to anti-redeposition properties, a white fabric included with the stained fabrics in an application of the disclosed solution may also exhibit higher reflection values. As an example, reflectance may be observed at 460 nanometers (460 nm).

An application of C10 branched chain ethoxylated alcohol having 5 moles ethylene oxide units combined with C12 straight chain ethoxylated alcohol having 7 moles ethylene oxide in the presence of a builder may include a laundry wash trial. An exemplary laundry wash trial may include the laundering of soiled fabrics in deionized water at 40° C. with a dosage of 0.4% weight by volume of the disclosed detergent composition in a 25 grams per liter (g/L) load. The wash trial may proceed in a tergotometer for example. The tergotometer may operate at 200 revolutions per minute (rpm) for a duration of 30 minutes. Upon completion of laundering, the fabric may be dried at room temperature.

The efficacy of the compositions described herein may be evaluated against a number of stain types. The solutions described herein may be useful in the treatment of a number of stains on a given fabric. These stains may include a number of food or food related items such as soy sauce, curry spices, ketchup, spinach, red grape, Coca Cola™, apple juice, beef lard, blackberry juice, black currant juice, blood, blueberry juice, butterfat with colorant, carrot baby food, carrot juice, chocolate, chocolate cream, chocolate milk/carbon black, and egg yolks. Other stains to which the solution may be applied include makeup stains, lipstick stains, shoe polish, and used motor oil. Blood/milk/ink combination stains may also be treated. Certain pigment stains may also be treated with the disclosed solution. These pigment stains include pigment lanolin, pigment sebum, pigment vegetable fat, and pigment egg. In some aspects, the soiled or stained fabric may be a fabric having a stain type according to any one of a number of WFK Testgewebe GmbH stain types or an EMPA of Switzerland standard stain type. For example, the stain may include one or more of soy sauce WFK 20V, pigment vegetable fat WFK 20PF, makeup WFK 20MU, curry WFK20U, pigment lanolin WFK 20C, ketchup WFK 20T, spinach WFK 20SP, Coca Cola™ WFK 20H, egg yolk WFK 20EG, lip stick WFK 20LS, pigment sebum WFK 20D, red grape WFK 20LIU, pigment egg WFK 20N, used motor oil WFK 20GM, shoe polish WFK 20S, or blood milk C EMPA 117. The white fabric may be a white fabric according to WFK Testgewebe GmbH WFK 20A.

To assess anti-redeposition performance, a white fabric may be added along with the stained fabrics during a treatment of the stained fabric with a given detergent. Treatment may include a laundry wash trial including the detergent. Reflectance of the unwashed, non-stained white fabric may be observed prior to a laundering and then observed after the wash trial with a given stained fabric. Reflectance values closer to that observed for the unwashed fabric may indicate that the detergent formulation is a suitable anti-redeposition agent. In some aspects, a white fabric included with the stained fabrics during a treatment of the disclosed solution may also exhibit higher reflection values than a white fabric included with the stained fabrics during a treatment with an alternate solution.

Definitions

It is to be understood that the terminology used herein is for the purpose of describing particular aspects only and is not intended to be limiting. As used in the specification and in the claims, the term "comprising" may include the aspects "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein. All publications mentioned herein are incorporated herein by reference to disclose and describe the methods and/or materials in connection with which the publications are cited.

As used in the specification and the appended claims, the singular forms "a," "an" and "the" include plural referents unless the context clearly dictates otherwise. Thus, for example, reference to "a polycarbonate" includes mixtures of two or more such polycarbonates. Furthermore, for example, reference to a filler includes mixtures of two or more such fillers.

Ranges can be expressed herein as from one value (first value) to another value (second value). When such a range is expressed, the range includes in some aspects one or both of the first value and the second value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

The term "anti-re-deposition" as used herein may refer to the capability of a composition or detergent formulation to facilitate sustained suspension of soils throughout the detergent solution and preventing removed soils/stains from being redeposited onto the substrate being cleaned. Anti-re-deposition properties may be evaluated according to a number of standards known in the art including, for example, ASTM D4008-95.

"Detergency" may refer to the removal of liquid or solid substances (i.e., stains) from a solid surface brought in contact with the sample.

"Hydrotrope" as used herein may refer to a substance or composition that improves the solubility of a surfactant in water. A hydrotrope may be particularly useful in a system containing high levels of builders or alkalinity. Hydrotropes belong to a special class of couplers requiring relatively low levels for solubilization of surfactants. Builders or other electrolytes may depress cloud point temperature or solubility of surfactants in aqueous systems. Hydrotropes may be used to adjust the cloud point of a formulation or solution. A higher concentration of hydrotrope generally leads to higher cloud points. The hydrotrope generally may not contribute to or detract from the performance of surfactant or builder.

The term "reflectance" as used herein refers to a ratio of the intensity of light or other radiation to that of the light or other radiation incident on a surface. Reflectance may be presented as a percentage and may be observed according to a number of standards known in the art including, for example, ASTM D 3050-07.

As used herein, the term or phrase "effective," "effective amount," or "conditions effective to" refers to such amount or condition that is capable of performing the function or property for which an effective amount is expressed. As will be pointed out below, the exact amount or particular condition required will vary from one aspect to another, depending on recognized variables such as the materials employed and the processing conditions observed. Thus, it is not always possible to specify an exact "effective amount" or "condition effective to." However, it should be understood that an appropriate effective amount will be readily determined by one of ordinary skill in the art using only routine experimentation.

Disclosed are component materials to be used to prepare disclosed compositions of the disclosure as well as the compositions themselves to be used within methods disclosed herein. These and other materials are disclosed herein, and it is understood that when combinations, subsets, interactions, groups, etc. of these materials are disclosed that while specific reference of each various individual and collective combinations and permutation of these compounds cannot be explicitly disclosed, each is specifically contemplated and described herein. For example, if a particular compound is disclosed and discussed and a number of modifications that can be made to a number of molecules including the compounds are discussed, specifically contemplated is each and every combination and permutation of the compound and the modifications that are possible unless specifically indicated to the contrary. Thus, if a class of molecules A, B, and C are disclosed as well as a class of molecules D, E, and F and an example of a combination molecule, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the compositions of the disclosure. Thus, if there are a variety of additional steps that can be performed it is understood that each of these additional steps can be performed with any specific aspect or combination of aspects of the methods of the disclosure.

References in the specification and concluding claims to parts by weight, of a particular element or component in a composition or article denotes the weight relationship between the element or component and any other elements or components in the composition or article for which a part by weight is expressed. Thus, in a composition containing 2 parts by weight of component X and 5 parts by weight component Y, X and Y are present at a weight ratio of 2:5, and are present in such ratio regardless of whether additional components are contained in the compound.

A weight percent of a component, unless specifically stated to the contrary, is based on the total weight of the formulation or composition in which the component is included. For example if a particular element or component in a composition or article is said to have 8% weight, it is understood that this percentage is relation to a total compositional percentage of 100%.

Compounds disclosed herein are described using standard nomenclature. For example, any position not substituted by any indicated group is understood to have its valence filled by a bond as indicated, or a hydrogen atom. A dash ("-") that is not between two letters or symbols is used to indicate a point of attachment for a substituent. For example, —CHO is attached through carbon of the carbonyl group. Unless defined otherwise, technical and scientific terms used herein have the same meaning as is commonly understood by one of skill in the art to which this disclosure belongs.

The term "comparable" as used herein may refer to similarity between given resin compositions described herein. Comparables may be used to express that properties, or the quantified values of given properties, are similar to or commensurate with the properties of another.

As used herein, the term "substantially identical reference composition" refers to a composition that is substantially identical to the inventive composition by consisting essentially of substantially the same proportions and components but in the absence of a single component.

The term "transparency" as used herein may refer to a level of transmittance for a resin composition that is greater than 50%, including exemplary transmittance values of at least 60%, 70%, 80%, 85%, 90%, and 95%, or any range of transmittance values derived from the above exemplified values. In some examples, the resin composition may exhibit a transmittance value of greater than 85%. Transmittance may be measured for a disclosed resin composition according to ASTM method D1003.

Aspects:

In various aspects, the present disclosure pertains to and includes at least the following aspects.

Aspect 1A. A composition comprising: a C10 aliphatic branched chain alcohol ethoxylate; a C12 aliphatic straight chain alcohol ethoxylate; and a reactive builder, wherein the composition effects an increase of at least 30% or at least about 30% in detergency measured as reflectance at 460 nm of a stained fabric at which the composition has been applied when compared to reflectance observed at 460 nm at the stained fabric prior to application of the composition, and wherein the stained fabric treated at which the composition has been applied exhibits a reflectance at 460 nm that is greater than the reflectance of the stained fabric at which a substantially similar composition has been applied, wherein the substantially similar composition comprises nonyl phenol ethoxylate.

Aspect 1B. A composition consisting essentially of: a C10 aliphatic branched chain alcohol ethoxylate; a C12 aliphatic straight chain alcohol ethoxylate; and a reactive builder, wherein the composition effects an increase of at least 30% or at least about 30% in detergency measured as reflectance at 460 nm of a stained fabric at which the composition has been applied when compared to reflectance observed at 460 nm at the stained fabric prior to application of the composition, and wherein the stained fabric treated at which the composition has been applied exhibits a reflectance at 460 nm that is greater than the reflectance of the stained fabric at which a substantially similar composition has been applied, wherein the substantially similar composition comprises nonyl phenol ethoxylate.

Aspect 1C. A composition consisting of: a C10 aliphatic branched chain alcohol ethoxylate; a C12 aliphatic straight chain alcohol ethoxylate; and a reactive builder, wherein the composition effects an increase of at least 30% or at least about 30% in detergency measured as reflectance at 460 nm of a stained fabric at which the composition has been applied when compared to reflectance observed at 460 nm at the stained fabric prior to application of the composition, and wherein the stained fabric treated at which the composition has been applied exhibits a reflectance at 460 nm that is greater than the reflectance of the stained fabric at which a substantially similar composition has been applied, wherein the substantially similar composition comprises nonyl phenol ethoxylate.

Aspect 1D. A composition comprising: a C10 aliphatic branched chain alcohol ethoxylate; a C12 aliphatic straight chain alcohol ethoxylate; and a reactive builder, wherein the composition effects an increase of at least 40% or at least about 40% in detergency measured as reflectance at 460 nm of a stained fabric at which the composition has been applied when compared to reflectance observed at 460 nm at the stained fabric prior to application of the composition, and wherein the stained fabric treated at which the composition has been applied exhibits a reflectance at 460 nm that is greater than the reflectance of the stained fabric at which a substantially similar composition has been applied, wherein the substantially similar composition comprises nonyl phenol ethoxylate.

Aspect 1E. A composition comprising: a C10 aliphatic branched chain alcohol ethoxylate; a C12 aliphatic straight chain alcohol ethoxylate; and a reactive builder, wherein the composition effects an increase of at least 50% or at least about 50% in detergency measured as reflectance at 460 nm of a stained fabric at which the composition has been applied when compared to reflectance observed at 460 nm at the stained fabric prior to application of the composition, and wherein the stained fabric treated at which the composition has been applied exhibits a reflectance at 460 nm that is greater than the reflectance of the stained fabric at which a substantially similar composition has been applied, wherein the substantially similar composition comprises nonyl phenol ethoxylate.

Aspect 2. The composition of any of aspects 1A-1E, wherein the substantially similar composition further comprises a builder.

Aspect 3. The composition of any of aspects 1A-2, wherein the composition is substantially free of nonyl phenol ethoxylate.

Aspect 4. The composition of any of aspects 1A-3, wherein the stained fabric comprises a stain of any one of the following stain types soy sauce WFK 20V, pigment vegetable fat WFK 20PF, makeup WFK 20MU, curry WFK 20U, pigment lanolin WFK 20C, ketchup WFK 20T, spinach WFK 20SP, Coca Cola™ WFK 20H, egg yolk 20EG, lipstick WFK 20LS, pigment sebum WFK 20D, red grape WFK 20LIU, pigment egg WFK 20N, used motor oil WFK 20GM, shoe polish WFK 20S, pigment olive oil WFK 20B, chocolate WFK 20Z, according to WFK Testgewebe GmbH or blood-milk C EMPA 117 according to EMPA of Switzerland standard stain type.

Aspect 5. The composition of any one of aspects 1A-4, wherein the C10 aliphatic branched chain alcohol ethoxylate comprises about 5 moles ethylene oxide.

Aspect 6. The composition of any of aspects 1A-4, wherein the C10 aliphatic branched chain alcohol ethoxylate comprises ethoxylated isodecyl alcohol 5EO.

Aspect 7. The composition of any one of aspects 1A-6, wherein the C12 aliphatic straight chain alcohol ethoxylate comprises 7 moles ethylene oxide.

Aspect 8. The composition of any one of aspects 1A-6, wherein the C12 aliphatic straight chain alcohol ethoxylate comprises ethoxylated dodecanol 7EO.

Aspect 9. The composition of any one of aspects 1A-8, wherein the reactive builder comprises sodium tri polyphosphate.

Aspect 10. The composition of any one of aspects 1A-9, wherein the C10 aliphatic branched chain alcohol ethoxylate and the C12 aliphatic straight chain alcohol ethoxylate are present in a weight ratio of about 1:1.

Aspect 11A. A composition comprising: at least a first alcohol ethoxylate and a second alcohol ethoxylate; and a reactive builder, wherein the composition effects an increase of at least 25% or at least about 25% in detergency measured as reflectance on a stained fabric treated with the composition when compared to reflectance observed at the stained fabric prior to treating with the composition.

Aspect 11B. A composition consisting essentially of: at least a first alcohol ethoxylate and a second alcohol ethoxylate; and a reactive builder, wherein the composition effects an increase of at least 25% or at least about 25% in detergency measured as reflectance on a stained fabric treated with the composition when compared to reflectance observed at the stained fabric prior to treating with the composition.

Aspect 11C. A composition consisting of: at least a first alcohol ethoxylate and a second alcohol ethoxylate; and a reactive builder, wherein the composition effects an increase of at least 25% or at least about 25% in detergency measured as reflectance on a stained fabric treated with the composition when compared to reflectance observed at the stained fabric prior to treating with the composition.

Aspect 12. The composition of any of aspects 11A-11C, wherein the composition is free or substantially free of nonyl phenol ethoxylate.

Aspect 13. The composition of any one of aspects 11A-12, wherein the first alcohol ethoxylate comprises an aliphatic straight chain alcohol ethoxylate comprising 5 moles ethylene oxide.

Aspect 14. The composition of any one of aspects 11A-12, wherein the first alcohol ethoxylate comprises a C12 straight chain alcohol ethoxylate comprising 5 moles ethylene oxide.

Aspect 15. The composition of any one of aspects 11A-14, wherein the second alcohol ethoxylate comprises an aliphatic branched chain alcohol ethoxylate comprising 7 moles ethylene oxide.

Aspect 16. The composition of any one of aspects 11A-14, wherein the second alcohol ethoxylate comprises a C10 branched chain alcohol ethoxylate comprising 7 moles ethylene oxide.

Aspect 17. The composition of any one of aspects 11A-16, wherein the reactive builder comprises sodium tri polyphosphate.

Aspect 18. The composition of any one of aspects 11A-17, wherein the reactive builder is present in an amount up to 1 wt. % or up to about 1 wt. % of the total weight of the composition.

Aspect 19. The composition of any one of aspects 11A-18, wherein the reactive builder is present in an amount of 0.05 wt. % or about 0.05 wt. % of the total weight of the composition.

Aspect 20. The composition of any one of aspects 11A-19, wherein the first alcohol ethoxylate and the second alcohol ethoxylate are present in a weight ratio of 1:1 or about 1:1.

Without further elaboration, it is believed that one skilled in the art can, using the description herein, utilize the present disclosure. The following examples are included to provide addition guidance to those skilled in the art of practicing the claimed disclosure. The examples provided are merely representative of the work and contribute to the teaching of the present disclosure. Accordingly, these examples are not intended to limit the disclosure in any manner.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior disclosure. Further, the dates of publication provided herein can be different from the actual publication dates, which can require independent confirmation.

EXAMPLES

The following examples are put forth so as to provide those of ordinary skill in the art with a complete disclosure and description of how the methods, devices, and systems disclosed and claimed herein are made and evaluated, and are intended to be purely exemplary and are not intended to limit the disclosure. Efforts have been made to ensure accuracy with respect to numbers (e.g., amounts, temperature, etc.), but some errors and deviations should be accounted for. Unless indicated otherwise, parts are parts by weight, temperature is in degrees Celsius (° C.) or is at ambient temperature, and pressure is at or near atmospheric.

Detergent samples were prepared using the components presented in Table 1. Samples were prepared by weighing a portion of the ethoxylates (1:1 weight ratio) and builder (0.05 wt. %) in a glass beaker and dissolving in a portion of deionized water. Deionized water was then added to bring the volume to 1 liter (for 0.1 wt. % of each ethoxylate).

TABLE 1

| | Component | Description |
|---|---|---|
| DA5 | Isodecyl alcohol (5 moles EO) | Branched ethoxylated alcohol |
| DA7 | Isodecyl alcohol (7 moles EO) | Branched ethoxylated alcohol |
| L7 | Lauryl alcohol (dodecanol) (7 moles EO) | Straight chain ethoxylated alcohol |
| NP9 | Nonyl phenol ethoxylate | Ethoxylated phenol |
| STPP | Sodium tri polyphosphate | Detergent builder |
| TA8 | Isotridecyl alcohol (8 moles EO) | Branched ethoxylated alcohol |
| TA10 | Isotridecyl alcohol (10 moles EO) | Branched ethoxylated alcohol |
| L9 | Lauryl alcohol (9 moles EO) | Straight chain ethoxylated alcohol |

Detergent solutions including one or more of DA5, LA7, STPP, and NP9 were prepared and evaluated based upon reflectance observed after the laundry wash trial described herein. Detergent solutions corresponding to Samples 6 and 7 included both nonionic surfactants DA5 and LA7 and were prepared so that DA5 and LA7 were present at a 1:1 ratio.

The fabric used for the laundry wash trials was a polyester cotton blend (70:30, cotton:polyester). The trials were conducted using a tergotometer and deionized water at 40° C. The wash trials were performed at 200 revolutions per minute (rpm) for 30 minutes with a load of 25 grams per liter (g/L) for samples 2-7. Sample 1 remained unwashed as a comparative sample. The laundered samples 2 through 7 were rinsed and dried at room temperature. Reflectance was obtained for each sample of laundered fabric according to the stain types. A white fabric was added to the wash trials with the stained fabrics. The reflectance measurements were performed on a Konica Minolta Spectrophotometer 3610A. All measurements are made after calibrating the instrument against a black standard and white standard of known reflectance. Measurements may be made according to the reference standard ASTM D 3050-07 (Standard Guide for Measuring Soil Removal from Artificially Soiled Fabrics). Reflectance of the unwashed, non-stained white fabric was obtained before and after each wash trial. Reflectance values closer to those observed for the unwashed fabric indicate that the sample shows anti-redeposition properties. Results are presented in Table 2.

TABLE 2

Reflectance for alkoxylated alcohols and builder for laundry wash trial evaluation

| | Reflectance (at 460 nm) | | | | | | |
|---|---|---|---|---|---|---|---|
| Stain type | 1 unwashed | 2 DA5 0.2% | 3 L7 0.2% | 4 NP9 0.2% | 5 STPP 0.2% | 6 DA5 0.1% + L7 0.1% | 7 DA5 0.1% + L7 0.1% + STPP 0.05% |
| Soy sauce WFK 20V | 29.6 | 73.2 | 73 | 69.9 | 73.7 | 72.2 | 75 |
| Pigment Vegetable fat WFK 20Pf | 31.3 | 58.9 | 60.4 | 62.4 | 41.4 | 63.2 | 64.8 |
| Makeup WFK 20MU | 49.6 | 56.9 | 58.1 | 57 | 66.5 | 57.6 | 68.4 |
| Curry WFK 20U | 44.7 | 64.3 | 65 | 60.6 | 60.1 | 65.3 | 66.9 |
| Pigment Lanolin WFK 20C | 34 | 44.6 | 45 | 44 | 38.5 | 45.1 | 48.8 |
| Ketchup WFK 20T | 54.5 | 70.5 | 68.9 | 67.8 | 71.7 | 69.1 | 71.4 |
| Spinach WFK 20SP | 50.4 | 73.3 | 73.8 | 69.1 | 72.3 | 73.4 | 73.1 |
| Coca cola ™ WFK 20H | 32.9 | 59.1 | 60.1 | 59.3 | 71.3 | 61.1 | 72.6 |
| Egg Yolk WFK 20EG | 47.9 | 57 | 53 | 56.1 | 60.7 | 53.2 | 65.3 |
| Lip stick WFK 20LS | 20.7 | 51.1 | 58.7 | 47.3 | 31.1 | 56.9 | 63.5 |
| Pigment Sebum WFK 20D | 34.4 | 60.5 | 60.8 | 62 | 42.7 | 61.4 | 63.9 |
| Red grape WFK 20KIU | 43.1 | 63.2 | 65 | 64.1 | 65.8 | 64.3 | 68.3 |
| Pigment Egg WFK 20N | 28.4 | 45.9 | 47.7 | 48.8 | 54.3 | 45.4 | 66.9 |
| Used motor oil WFK 20GM | 30.9 | 40.8 | 40.7 | 39.8 | 36.6 | 40.4 | 44.3 |
| Shoe polish WFK 20S | 6.2 | 11.4 | 11.6 | 12.1 | 11.2 | 11.2 | 12.7 |
| Pigment Olive oil WFK 20B | 34.9 | 47.8 | 49.2 | 47.8 | 39.9 | 46.5 | 52.8 |
| Chocolate WFK 20Z | 48.2 | 64.6 | 65.7 | 65 | 65 | 67.6 | 67.8 |
| Blood, milk C EMPA 117 | 9.8 | 13.6 | 13 | 14.5 | 33.6 | 12.8 | 49.8 |
| White fabric WFK 20A | 84.8 | 72.8 | 74.2 | 73.9 | 74.7 | 73.3 | 76.3 |
| Reflectance % difference from unwashed white fabric | NA | 14.2 | 12.5 | 12.9 | 11.9 | 13.6 | 10.0 |

As shown in Table 2, laundered sample 7 including DA5, L7, and STPP exhibited the highest reflectance among the samples observed. Sample 7 showed at least a 30% increase in reflectance compared to the unwashed sample for each stain type observed. Sample 7 including the two nonionic ethoxylated surfactants and phosphate builder exhibited a better reflectance than the individual ethoxylated alcohols (samples 2 and 3) and better than the alkoxylated phenol alone (sample 4) detergent builder alone (sample 5). It is the synergistic effect of DA5, L7, and the detergent builder that provided improved reflectance as sample 7 also exhibited higher reflectance than the combined nonionic surfactants (sample 6). With respect to anti-redeposition, sample 7 exhibited a reflectance value closest to the unwashed white fabric (at 10%) when compared to remaining samples 2-6 (each at greater than 10%).

Laundry wash trials were also performed for several other combinations of ethoxylates formed by the components presented in Table 1. Results are presented in Tables 3A and 3B.

TABLE 3A

| | Reflectance (at 460 nm) | | | | | | | |
|---|---|---|---|---|---|---|---|---|
| | UW | DA5 + L7 | TA8 + L7 | TA10 + L7 | DA7 + L7 | DA5 + L7 + STPP | TA8 + L7 + STPP | TA10 + L7 + STPP |
| Soy sauce WFK 20V | 29.6 | 73.9 | 74.2 | 72.6 | 72.3 | 76.6 | 76.9 | 77.3 |
| Pigment Veg fat WFK20Pf | 31.3 | 62.8 | 62.8 | 55.4 | 51.1 | 70.2 | 67.5 | 63.7 |
| Makeup WFK 20MU | 49.6 | 58.1 | 58.1 | 57.4 | 55.5 | 69.7 | 68.5 | 69 |
| Curry WFK 20U | 44.7 | 62.6 | 61.8 | 63.8 | 61.9 | 66.2 | 65.4 | 65.4 |
| Pigment Lanolin WFK20C | 34 | 46.9 | 45.1 | 41.4 | 41.2 | 56.7 | 54.7 | 49.3 |
| Ketchup WFK 20T | 54.5 | 70.6 | 70.1 | 70 | 68.4 | 72.6 | 72.4 | 71.7 |
| Spinach WFK 20SP | 50.4 | 72.8 | 71.9 | 71.6 | 71.1 | 75.2 | 74.7 | 75.1 |
| Coca cola WFK 20H | 32.9 | 59.1 | 58.8 | 60.9 | 58.3 | 75.3 | 75.9 | 75.8 |
| Egg Yok WFK 20EG | 47.9 | 57.2 | 55 | 55.6 | 55.4 | 63.7 | 62.5 | 61.8 |
| Lip stick WFK 20LS | 20.7 | 54.5 | 48.9 | 35.3 | 38.9 | 61.9 | 58.1 | 49.1 |
| Pigment Sebum WFK20D | 34.4 | 61 | 58 | 52.1 | 57.1 | 69.1 | 68 | 68 |
| Red grape WFK 20KIU | 43.1 | 64.4 | 64.3 | 64.3 | 63.3 | 70.5 | 70.8 | 70.5 |
| Pigment Egg WFK 20N | 28.4 | 45.6 | 45.1 | 46 | 46.9 | 57.2 | 56.5 | 58.6 |
| Used motor oil WFK 20GM | 30.9 | 40.1 | 39.2 | 39.4 | 40.3 | 49.9 | 50.1 | 46.7 |
| Shoe polish WFK 20S | 6.2 | 10.2 | 10.3 | 11 | 10.9 | 13.5 | 14.2 | 14.8 |
| Pigment Olive oil WFK 20B | 34.9 | 50.8 | 48.1 | 43 | 44.9 | 60.9 | 57.8 | 51.7 |
| Chocolate WFK 20Z | 48.2 | 65 | 65 | 65.8 | 64.2 | 69.5 | 71 | 68.7 |
| Blood, milk C EMPA 117 | 9.8 | 13 | 14.3 | 13.5 | 13 | 43.1 | 42.9 | 42.1 |
| White fabric WFK 20A | 84.8 | 74.5 | 74.3 | 74.5 | 73.9 | 77.8 | 76.9 | 78 |
| Total | 631.5 | 968.6 | 951.0 | 919.1 | 914.7 | 1121.8 | 1107.9 | 1079.3 |

TABLE 3B

| | Reflectance (at 460 nm) | | | | | | | | | |
|---|---|---|---|---|---|---|---|---|---|---|
| | TA10 + L7 + STPP | DA7 + L7 + STPP | DA5 + L9 | TA8 + L9 | TA10 + L9 | NP9 | DA5 + L9 + STPP | TA8 + L9 + STPP | DA10 + L9 + STPP | NP9 + STPP |
| Soy sauce WFK 20V | 77.3 | 76.4 | 72.5 | 73.07 | 73.19 | 73.06 | 75.68 | 75.49 | 76.05 | 75.4 |
| Pigment Veg fat WFK 20Pf | 63.7 | 65.8 | 56.08 | 55.59 | 45.67 | 62.49 | 66.69 | 67.3 | 61.71 | 67.52 |
| Makeup WFK 20MU | 69 | 67.9 | 43.69 | 57.58 | 57.27 | 57.86 | 68.56 | 68.58 | 68.58 | 67.28 |
| Curry WFK 20U | 65.4 | 65.4 | 63.16 | 62.94 | 63.17 | 62.81 | 63.54 | 64.45 | 65.37 | 65.49 |
| Pigment Lanolin WFK 20C | 49.3 | 48.1 | 41.66 | 42.6 | 40.95 | 44.7 | 51.13 | 48.96 | 49.8 | 50.36 |
| Ketchup WFK 20T | 71.7 | 71.6 | 68.77 | 67.33 | 69.42 | 67.57 | 71.33 | 70.71 | 71.11 | 70.61 |
| Spinach WFK 20SP | 75.1 | 74.7 | 70.56 | 70.84 | 71.97 | 71.82 | 73.58 | 72.99 | 73.08 | 74.39 |
| Coca cola WFK 20H | 75.8 | 74.9 | 59.06 | 60.72 | 59.75 | 59.84 | 73.91 | 74.17 | 74.61 | 74.51 |
| Egg Yok WFK 20EG | 61.8 | 62.8 | 56.92 | 56.49 | 57.51 | 56.53 | 63.62 | 62.13 | 62.61 | 62.55 |
| Lip stick WFK 20LS | 49.1 | 50.1 | 37.09 | 36.09 | 32.16 | 45.86 | 49.23 | 47.81 | 44.11 | 54.42 |
| Pigment Sebum WFK 20D | 68 | 67.7 | 56.63 | 55.63 | 50.05 | 62.58 | 66.05 | 65.84 | 65.12 | 66.97 |
| Red grape WFK 20KIU | 70.5 | 68.3 | 64.14 | 63.52 | 64.72 | 64.44 | 69.04 | 68.59 | 68.99 | 67.94 |

TABLE 3B-continued

| | Reflectance (at 460 nm) | | | | | | | | | |
|---|---|---|---|---|---|---|---|---|---|---|
| | TA10 + L7 + STPP | DA7 + L7 + STPP | DA5 + L9 | TA8 + L9 | TA10 + L9 | NP9 | DA5 + L9 + STPP | TA8 + L9 + STPP | DA10 + L9 + STPP | NP9 + STPP |
| Pigment Egg WFK 20N | 58.6 | 57.4 | 46.79 | 46.95 | 46.46 | 44.05 | 55.06 | 57.7 | 58.38 | 56.19 |
| Used motor oil WFK 20GM | 46.7 | 48 | 39.43 | 38.88 | 38.1 | 40.16 | 49.18 | 46.27 | 42.8 | 47.29 |
| Shoe polish WFK 20S | 14.8 | 14.9 | 11.1 | 9.84 | 9.93 | 11.66 | 13.2 | 12.64 | 12.84 | 13.53 |
| Pigment Olive oil WFK 20B | 51.7 | 51.9 | 42.99 | 43.69 | 40.06 | 46.13 | 52.18 | 49.99 | 47.67 | 49.84 |
| Chocolate WFK 20Z | 68.7 | 70.8 | 64.71 | 64.95 | 64.88 | 65.2 | 68.11 | 68.33 | 68.97 | 67.97 |
| Blood, milk C EIVIPA 117 | 42.1 | 42.5 | 13.65 | 13.81 | 13.85 | 13.09 | 41.62 | 41.77 | 44.09 | 43.02 |
| White fabric WFK 20A | 78 | 77 | 73.08 | 73.44 | 73.92 | 73.66 | 76.42 | 76.41 | 76.78 | 76.23 |
| Total | 1079.3 | 1079.2 | 908.9 | 920.5 | 899.1 | 949.9 | 1071.7 | 1063.7 | 1055.9 | 1075.3 |

The synergistic effect of the DA5+L7+STPP combination is apparent. The sample including these three components together that exhibited the highest overall values for reflectance (see totals). Further, the DA5+L7+STPP a reflectance close to that observed at the unwashed white fabric, although the value for the TA10+L7+STPP combination was closer.

It will be apparent to those skilled in the art that various modifications and variations can be made in the present disclosure without departing from the scope or spirit of the disclosure. Other aspects of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A composition consisting of:

a C10 aliphatic branched chain alcohol ethoxylate;

a straight chain alcohol ethoxylate of the formula

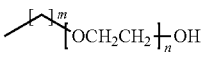

where m is between 8 and 14 and n is from 2 to 10; and a reactive builder, wherein the composition effects an increase of at least about 30% in detergency measured as reflectance at 460 nm of a stained fabric at which the composition has been applied when compared to reflectance observed at 460 nm at the stained fabric prior to application of the composition, and wherein the stained fabric treated at which the composition has been applied exhibits a reflectance at 460 nm that is greater than the reflectance of the stained fabric at which a substantially similar composition has been applied, and wherein the substantially similar composition comprises nonyl phenol ethoxylate.

2. The composition of claim 1, wherein the C10 aliphatic branched chain alcohol ethoxylate and the straight chain alcohol ethoxylate are present in a weight ratio of about 1:1.

3. The composition of claim 1, wherein the stained fabric comprises a stain selected from the group consisting of soy sauce WFK 20V, pigment vegetable fat WFK 20PF, makeup WFK 20MU, curry WFK 20U, pigment lanolin WFK 20C, ketchup WFK 20T, spinach WFK 20SP, egg yolk 20EG, lipstick WFK 20LS, pigment sebum WFK 20D, red grape WFK 20LIU, pigment egg WFK 20N, used motor oil WFK 20GM, shoe polish WFK 20S, pigment olive oil WFK 20B, chocolate WFK 20Z, according to WFK Testgewebe GmbH or blood-milk C EMPA 117 according to EMPA of Switzerland standard stains.

4. A composition consisting of:

a C10 aliphatic branched chain alcohol ethoxylate;

a straight chain alcohol ethoxylate of the formula

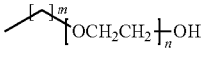

wherein m is between 8 and 14 and n is from 2 to 10; and a reactive builder, wherein the reactive builder comprises sodium tri polyphosphate.

* * * * *